United States Patent [19]

Wyatt

[11] 4,442,898

[45] Apr. 17, 1984

[54] DOWNHOLE VAPOR GENERATOR

[75] Inventor: William G. Wyatt, Arlington, Tex.

[73] Assignee: Trans-Texas Energy, Inc., Dallas, Tex.

[21] Appl. No.: 349,208

[22] Filed: Feb. 17, 1982

[51] Int. Cl.[3] ..... E21B 36/02; E21B 43/24

[52] U.S. Cl. ..... 166/303; 166/59; 122/31 R; 431/158

[58] Field of Search ..... 166/302, 303, 59, 58, 166/57, 256; 175/14; 60/39.55; 122/31 R, 31 A; 126/360 A; 431/158, 4, 190, 243

[56] References Cited

U.S. PATENT DOCUMENTS

| | | | |
|---|---|---|---|
| 3,980,137 | 9/1976 | Gray | 166/303 |
| 4,336,839 | 6/1982 | Wagner et al. | 166/303 |
| 4,366,860 | 1/1983 | Donaldson et al. | 166/303 |

FOREIGN PATENT DOCUMENTS

| | | | |
|---|---|---|---|
| 271706 | 5/1927 | United Kingdom | 60/39.55 |
| 283290 | 1/1928 | United Kingdom | 60/39.55 |

*Primary Examiner*—James A. Leppink
*Assistant Examiner*—Hoang C. Dang
*Attorney, Agent, or Firm*—Thomas L. Cantrell; Joseph H. Schley; Stanley R. Moore

[57] ABSTRACT

Disclosed is a method and apparatus for generating high pressure steam within a well bore for facilitating recovery of hydrocarbon deposits. The steam vapor generator is constructed for receiving high pressure water, fuel and oxidant in a downhole position for select mixing and combustion. High pressure water is received around a combustion chamber in an annular configuration and heated through a thermal wall region forming a lower portion thereof. The combustion chamber utilizes the heat energy of radiation to heat the water in the annular sleeve to the point of steam. The water sleeve further includes orifices for egress of the steam and a plurality of vent tubes within the water sleeve. The vent tubes extend substantially the length of the sleeve for receiving excess water vapor and/or undissolved gases created from the heat of vaporization and out-gassing. A collection chamber is provided beneath the combustion chamber in communication with the vent tubes and water sleeve for the mixing of the high pressure vapor and the exhaust thereof into the adjacent well formation.

23 Claims, 3 Drawing Figures

DOWNHOLE VAPOR GENERATOR

BACKGROUND OF INVENTION

The invention relates to vapor generators and, more particularly, to a downhole vapor generator utilizing the combustion of air and fuel to radiantly and convectantly heat water for the creation of steam and the pressurized injection thereof into adjacent downhole hydrocarbon formations.

Many forms of stimulation processes have been employed for increasing productivity of hydrocarbon deposits such as oil and gas wells. The devices utilized in such stimulation processes generally include the generation of both heat and pressure to lower the viscosity of adjacent petroleum, eliminate deposits of materials such as paraffin and impart flow to an adjacent production well. Many processes utilizing such concepts have been employed and/or taught in the prior art. One apparatus is shown and described in U.S. Pat. No. 3,315,745 which discloses a bottom hole burner for introducing heat directly into a downhole formation. The burner comprises a combustion chamber for the mixing of fuel and air and the in situ combustion thereof with the well. An ignition device is provided in the upper end of the combustion chamber. The combustion creates a high pressure level and hot gases are emitted as long as combustion is maintained. These devices are useful for sustaining in situ combustion from oil in the formation surrounding the well.

Another downhole heating technique is set forth and described in U.S. Pat. No. 3,980,137, which discloses a steam generation and injection system. Oil and gas well production has been shown to be increased by pumping pressurized steam directly into the well as compared to the in situ downhole combustion technique set forth above. The injection of steam not only heats the formation but also facilitates the elimination of deposits of materials such as paraffin as well as dissolving obstructions that impend the flow of petroleum products in such formations into producing wells. It has been shown that an increase in reservoir temperature from 80° Fahrenheit to 200° Fahrenheit results in a 27 fold decrease in crude oil viscosity. A decrease in the viscosity affords an increase in the free flowability of what otherwise would be termed as "frozen" oil.

Steam injection systems of the prior art have incorporated fuel-air mixtures delivered to combustion chambers of various designs disposed in downhole configurations. Steam is generally generated from water delivered directly into the combustion chamber where it is converted into vapor. The temperature and pressure of the vapor passing from the combustion chamber is then controlled by adjusting the flow rate of the fuel-air mixture as well as the flow rate of coolant, or water, delivered thereto. Heat transfer to feed water in such combustion chambers is effected primarily by conduction rather than through radiation heating from the flame. Such combustion is often stoichiometric and generally sustained by a mixture of hydrogen and an oxidant such as oxygen. Since hydrogen combustion creates very little radiant heat, such systems prevent overheating of the adjacent well casing which can deleteriously occur with escape of radiant energy from less advanced downhole combustion apparatus.

The general problems of prior art methods and apparatus for downhole burners have included the overheating of adjacent well casing, inefficient heat dissipation, operation cost, efficiency and reliability. It would be an advantage to use fuel less expensive than hydrogen due to the enormous related expense of secondary recovery operations. However, an efficient and reliable system must be provided for downhole use.

The creation of steam by vapor generators encompasses a wide range of prior art technology. For example, early torpedo designs have utilized vapor generators for propulsion. One such structure is described in British Pat. No. 140,156 accepted Mar. 23, 1920. The vapor generator set forth in the British reference utilizes steam and the products of combustion for creating kinetic energy to drive the torpedo. The fuel is burned under suitable pressure in a combustion chamber. At one end of the chamber the burners are situated while the other end the chamber is open to mixing. Water is supplied to an annular space surrounding the combustion chamber. Water flowing through the annular space cools the combustion chamber walls while being heated. The flame from the burner fills the combustion chamber and the flames strike the water egressing from the annular space converting the preheated water into steam. This basic concept has been incorporated into downhole steam injector structures such as that set forth in the aforesaid U.S. Patent.

In a downhole well bore application, certain aspects of vapor generation must be controlled. For example, various gases can become trapped in the coolant, or feed water. These gases can bubble out causing vapor-lock and/or separating the coolant from chamber walls which can lead to serious over-heating. It may thus be seen that excess heat from conductive and/or radiant heating must be minimized. The torpedo concept described above is effective in the generation of steam from an annular heating region about a combustion chamber, but there is ample room to dissipate excess heat. The particular water, chemical, mineral compositions found in downhole operations necessitate certain improvements of the aforesaid basic steam generator designs of the prior art. Out-gasing and preliminary steam generation in an annular pre-heating chamber can cause problems of over-heating of the combustion walls, vapor locking and related problems that can cause shut down of the downhole operation. It may be seen that the expense involved in downhole failures places an emphasis on unit reliability and the aforesaid problems.

It would be an advantage therefore to provide a downhole vapor generator having improved features of out-gas control, maximization of heat generation and minimal heat dissemination into the adjacent well bore casing. The vapor generator of the present invention provides such a method and apparatus by incorporating a concentrically aligned combustion and feed system having an annular heating region about a centralized combustion zone. The water within the annular feed chamber is heated through a thermal radiation zone rather than brought into contact with the flame and prior to mixing with the products of combustion in the combustion chamber, for egressing into the adjacent hydrocarbon formation.

SUMMARY OF THE INVENTION

The invention relates to a downhole vapor generator and method of creating steam in a high pressure configuration adjacent hydrocarbon formations. More particularly the subject invention comprises an improved downhole vapor generator of the type constructed for injecting steam and hot gases produced from water and gases present in the water into a well bore formation. The vapor generator is of the type secured within a well bore and supplied with fuel and air for the mixing and burning thereof and transformation of water supplied thereto and maintained therein at an established level, into steam and hot gases. The steam and gases are exhausted under pressure into an adjacent well bore formation. The improvement of the present invention comprises an annular water sleeve cylindrically encompassing a combustion chamber within the vapor generator. The sleeve includes at least one venting tube longitudinally disposed therein and secured substantially along the length of the water sleeve with one end thereof above the water level for receiving gases emitted by the water flowing into and within the sleeve.

In yet another aspect the invention includes a method of generating steam within a well bore with a vapor generator disposed therein. The method comprises the steps of delivering a combustible fuel, oxygen, and water to the vapor generator within the well bore and mixing the fuel and oxygen within the combustion chamber of the vapor generator. The fuel and air mixture is ignited within the combustion chamber and combustion is sustained therein for generating radiant heat. Water is passed around the combustion chamber, establishing a water level therein, and absorbing radiant heat from the combustion within the combustion chamber. The water is thus converted to steam. Means are provided for egress of gases present in the water and emitted by the water while being heated within the vapor generator. The steam formed from the heated water and the gases emitted by the water are vented into a mixing region beneath the combustion occuring within the combustion chamber. The steam and hot gases are then available for injection into well bore formations.

BRIEF DESCRIPTION OF THE DRAWINGS

For a more complete understanding of the present invention and for further objects and advantages thereof, reference may now be had to the following description taken in conjunction with the accompanying drawings, in which.

DETAILED DESCRIPTION

Figure 1:
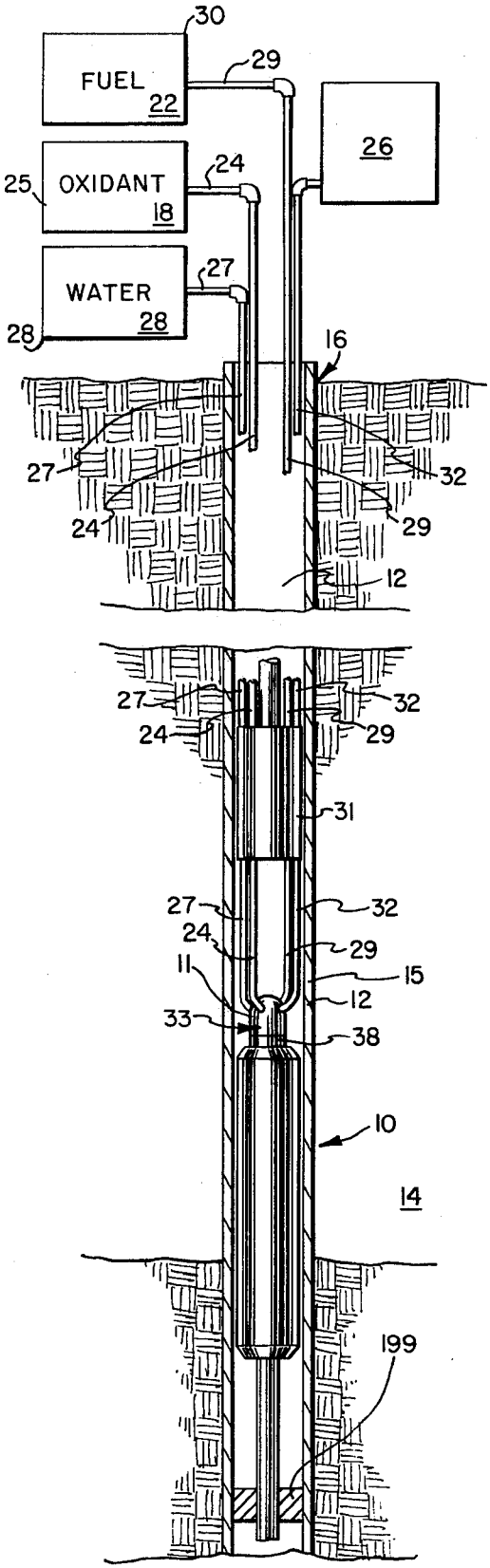
FIG. 1 is a diagrammatic, side-elevational view of a well bore with a vapor generator mounted therein and constructed in accordance with the principles of the present invention.

Referring first to FIG. 1, there is shown a diagrammatic view of one embodiment of the method and apparatus of the present invention. A vapor generator 10 constructed in accordance with the principles of the present invention is shown positioned with a well bore 12 in a downhole configuration adjacent to the desired formation 14. A well casing 15 lines the wall of the well bore 12 through the formation 14 to the top of the well head 16. At the well head 16 there is supplied pressurized air 18, pressurized water 20, and fuel 22 for combustion in the downhole generator 10. The vapor generator 10 in its downhole position then receives the fuel, oxidant in the form of air, and water 22, 18, and 20 respectively and mixes said elements in the presence of combustion and radiant heat to create high pressure steam which is emitted from the generator 10 into the formation 14. This step greatly facilitates secondary hydrocarbon recovery and may be used in related well bore operations, as set forth in copending U.S. patent application, Ser. No. 349,653 assigned to the assignee of the present invention.

Addressing now the area of the well head 16 of FIG. 1, an oxidant supply line 24 is provided and extends from a pressurized tank 25 into the well bore 12 to the generator 10. Several oxidants may be used including air, and hereinafter the term "air" will be used as meaning any conventional oxidant adapted for downhole combustion with a fuel. Water line 27 is next shown extending from a water storage tank 28 into the well bore 12. It should be seen that these supply lines are diagrammatically shown and in fragmentary form for purposes of clarity. Line 27, for example, terminates beneath the well head 16 to facilitate illustration of the various lines and cables which extend to the generator 10. A fuel line 29 likewise extends from a conventional fuel storage tank 30 into the well bore 12.

Figure 2:
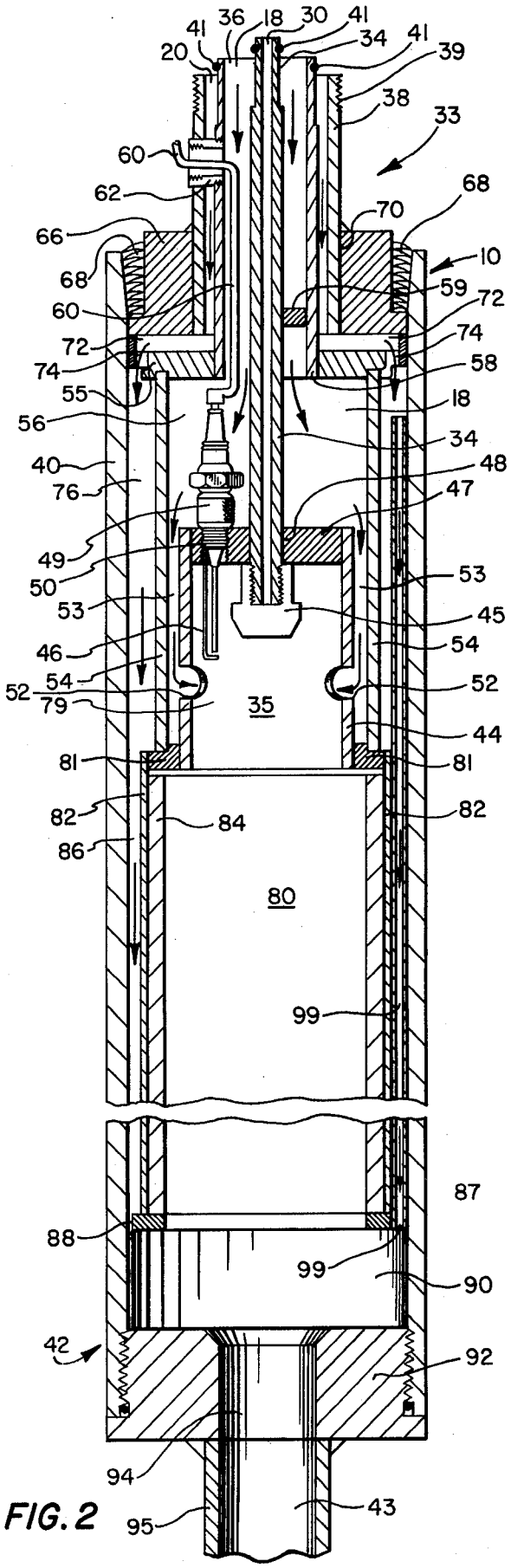
FIG. 2 is an enlarged, cross-sectional, side-elevational view of the vapor generator of FIG. 1.

Still referring to FIG. 1, there is shown above the vapor generator 10, a spark generator 31 for providing high voltage power to ignite the generator 10. A power cable 32 is thus shown connecting the spark generator 31 to a control station 26 situated at the well head 16. The central station 26, of the present invention, is constructed to provide high current, low voltage power to the downhole spark generator 31 where a high voltage current may be communicated with ignition means within the vapor generator 10. The central station may then monitor the combustion in a manner set forth and described in more detail, in copending U.S. patent application Ser. No. 349,653. Beneath the spark generator 31, supply lines 24, 27 and 29 are coupled into a single tubular, concentric feed line for supplying the constituents for combustion and steam generation in the unit 10. Air line 24 is thus shown to merge in a conventional concentric pipe head coupling 11 at an upper end 33 of the generator 10 with water line 27 and fuel line 29. The actual construction of the coupling 11 is not shown although the concentric tubular interconnection of the upper generator section 33 is shown in FIG. 2. Also not shown is the routing of power line 32 which is coupled to air line 24 and fed back to the spark generator 31 where high voltage current is produced and supplied to the vapor generator 10 along a high voltage power line 60, which enters the generator 10 through a side wall aperture 62 (shown in FIG. 2). Such design and routing should be readily understood by a person skilled in the art.

Referring now to FIG. 2 there is shown an enlarged, side elevational, cross-sectional view of a vapor generator 10 constructed in accordance with the principles of the present invention. At the upper end 33 of the generator 10 there is provided means for coupling concentric fuel, air, and water lines, of the coupling head 11 to the generator 10. A generator fuel line 34 thus upstands for coupling to the coupling head 11 and is centrally disposed in the upper end 33 of the generator 10, extending downwardly therein to central combustion chamber 35. An air passage 36 concentrically surrounds fuel line 34 and similarly channels air 18 to the combustion chamber 35. An outer casing section 38, having upper threaded portion 39, provides longitudinal structural support and interconnection of the generator 10 and concentric pipe coupling 11. Casing 38 is likewise adapted for containing the flow of water 20 therein from coupling 11 which is in flow communication with water line 27. A series of 'O' rings 41 are provided around the coupling ends of fuel line 34 and air line 36 for affording sealed communication with the concentric structure of coupling 11.

The intermediate body of the vapor generator 10 is constructed of stainless steel or the like and comprises an outer casing 40 which houses the flow passages for the fuel, air and water necessary for operation as well as housing the combustion chamber 35 therein. Lower end 42 of the generator 10 is constructed with an exhaust port 43 for emission of the high pressure steam and gases generated within the unit 10.

Combustion chamber 35 is formed with an upper mixing chamber 79 having walls 44 cylindrically disposed thereabout. A fuel exhaust nozzle 45 is disposed therein adjacent a spark igniter 46. The fuel nozzle 45 is secured to the fuel line 34 through an upper chamber bulk head 47, which receives the fuel line 34 through a central aperture 48 formed therethrough. Bulk head 47 is secured to chamber walls 44 and forms the upper end thereof. A spark igniter 46 extends downwardly from a spark plug 49 secured within the bulk head 47 through a threaded aperture 50 positioned adjacent the central fuel aperture 48. In this manner electrical spark may be provided immediately adjacent and in engagement with the fuel 22 discharged from the nozzle 45.

Still referring to FIG. 2, beneath the lower end of the igniter 46 and fuel nozzle 45 there is provided a plurality of apertures 52 formed tangentially through wall 44 for entry of air 18 into the combustion chamber 35. It may be seen that upper chamber walls 44 are formed within a second outer wall 54 comprising an air sleeve 53 which provided flow communication for the air 18 received from upper air line 36. Outer walls 54 are secured and sealed at the top thereof by secondary bulk head 55 which forms an intermediate chamber 56. Chamber 56 houses the spark plug 49 and a lower portion of fuel line 34. Bulk head 55 is also formed with a central aperture 58 having secured therein the air pipe 36. A spacer 59 may be utilized to centrally position the fuel line 34 within the air pipe 36. It may be seen that the air line 36 terminates at and is secured to the bulk head 55. Within air pipe 36, a spark plug connection wire 60 is fed to the spark plug 49 and air 18 is permitted to enter the chamber 56 around the spark plug 49. Air 18 flows downwardly around the combustion chamber wall 44 within the air sleeve 53 for entry into the combustion chamber 35 through the tangential entry ports 52. In the upper air pipe 36, an aperture 62 is formed in the side wall portion thereof for receiving the spark plug wire 60 and facilitating connection with the spark generator 31.

The outer casing 40 of the generator 10 is terminated at its upper end by an outer bulk head 66, preferably welded to casing 40 as shown by weld fillets 68 therearound. A central aperture 70 formed through the bulk head 66 permits entry of the drill string coupling casing 38 and the fuel, air, and water lines therein. Casing 38 is fixedly mounted within the bulk head 66. Spacers other than fuel line spacer 59 are not shown for purposes of clarity. What is shown is bulk head 66 being longitudinally spaced from intermediate bulk head 55 which forms an entry chamber or passage 72 therebetween. Chamber 72 may also be comprised of a plurality of flow passages formed in the top surface of bulk head 55 rather than simply spaced from bulk head 66 as shown. Water 20, thus flows from pipe 38 and through passage 72. Apertures 74 are formed along the outer periphery of the bulk head 55 for allowing water 20 in passage 72 to flow into the annular space formed between outer casing walls 40 and upper combustion chamber walls 44 to comprise a water jacket 76. Within this annular jacket 76, water 20 is permited to flow downwardly where it is heated and converted into high pressure steam.

Figure 3:
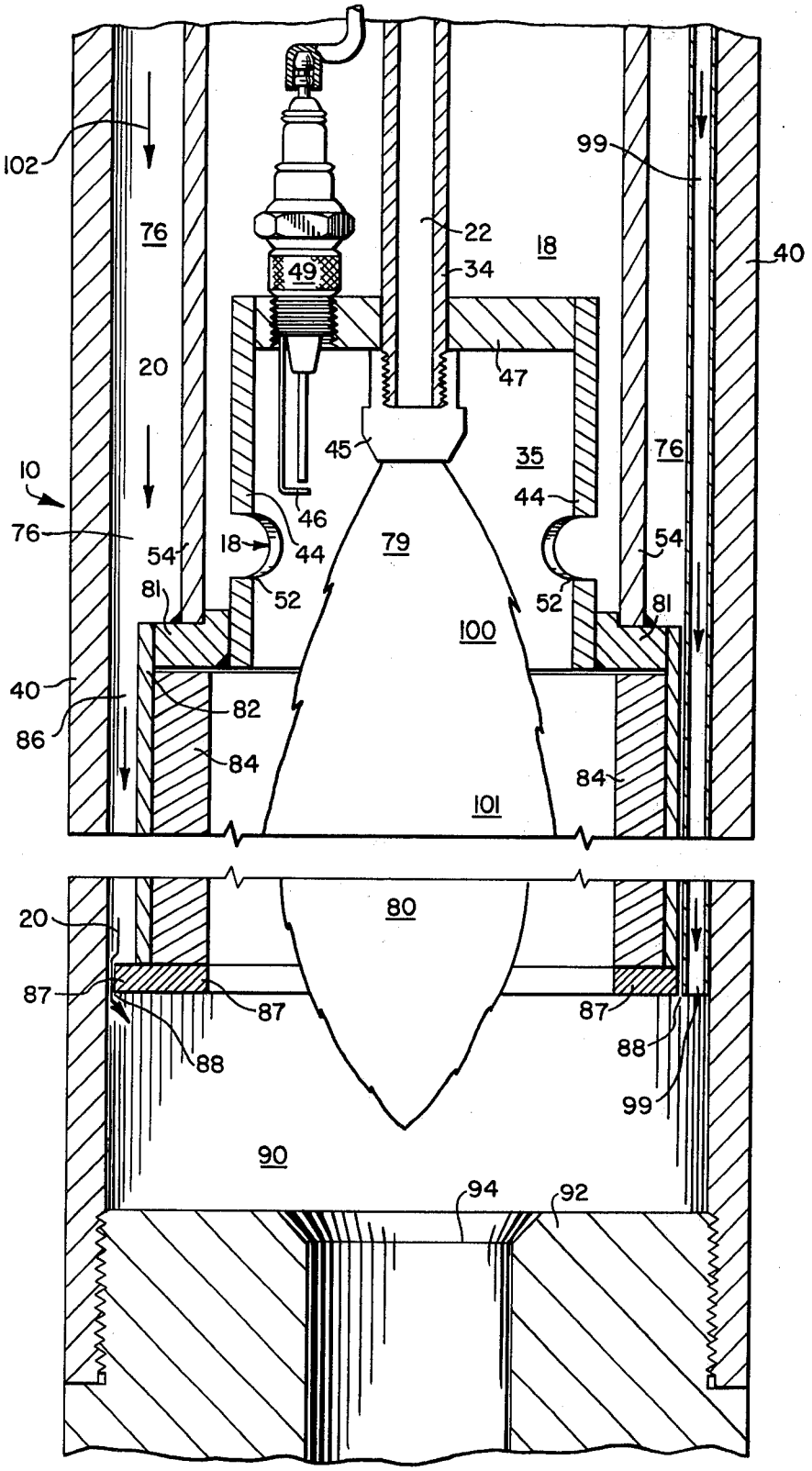
FIG. 3 is an enlarged, cross-sectional, fragmentary view of the vapor generator of FIG. 2 illustrating one aspect of operation thereof.

Referring now to FIG. 3, there is shown an enlarged view of the intermediate region of the generator 10 and particularly combustion chamber 35 within the cylindrical walls 44 and 54. The combustion chamber 35 includes the upper mixing chamber 79 and a lower heat generation thermal zone, or chamber 80. Heating chamber 80 may be seen to be constructed with an increased diameter for permitting expansion of the mixture of gases and fuel combustion of the air and fuel constituents. Chamber 80 is constructed with cylindrical, outer chamber walls 82 terminating at the top at ring bulk head 81 and at the bottom at sleeve bulk head 87. The walls 82 thus form a lower, more narrow water jacket 86 beneath upper jacket 76, wherein maximum heating of the water 20 is effected.

The jacket walls 82 further include a thermal lining 84, preferably comprised of high temperature mortar, for receiving and radiating the heat generated by the combustion occuring the thermal zone walls 84 absorb and radiate the combustion heat outwardly through the thinner jacket walls 82 and into the annular water jacket 86.

Apertures 88 are formed through the bulk head 87 for releasing the heated water and steam formed within the water jacket 86. The steam from apertures 88 and the flame from combustion in chamber 80 is permitted to exhaust into a chamber 90 formed beneath bulk head 87 and above a lower casing bulk heat 92, terminating the lower end of the generator casing 40. A central aperture 94 is formed through the bulk head 92 for receiving an emission exhaust pipe 95 which forms a means of egress for the steam and gases generate within the upper generator portions.

Referring now to FIGS. 2 and 3 in combination, a plurality of vent tubes 99 are preferably disposed around the combustion chamber 35 for receiving and venting gaseous byproducts. The introduction of water 20 into the water jackets 76 and 86 has been shown to produce out-gasing of disolved gases in the water. Preliminary vaporization of the water 20 in upper jacket 76 has also been shown to be a problem. The gas and vapor can cause vapor-lock as well as over-heating when water is absent from the thermal zone. The vent tubes 99 afford a means of egress of such gases and vapor whereby a constant water level 102 is maintained above the thermal zone 80. At top opening 104 of the vent tube 99 is thus shown above the water level 102 for carrying away the out-gased byproducts and/or preliminary water vapor which has bubbled upwardly thereto.

In operation, fuel 22 is provided under pressure in fuel tank 30 at the well head 16. The fuel may be liquid propane or the like which is relatively inexpensive compared to certain other fuels utilized in the prior art for downhole combustion. Water 20 is likewise provided under pressure in storage tank 28, and an oxidant such as air 18 is provided under pressure in storage tank 25 and/or from a compressor (not shown). Once the vapor generator 10 has been positioned at the desired location at the formation 14 within the well bore 12, the respective constituents are connected to the supply string 26. A downhole communication link for initiating combustion is comprised of cable 32 connected to spark generator 31. Within the vapor generator 10, air and fuel are permitted to enter the upper combustion chamber 35. The tangential entry of the air 18 through ports 52, as shown by the arrow in FIG. 3, causes turbulence and facilitates mixing of the fuel 22 discharged from the nozzle 45. A spark from the element 46 of the spark plug 49 causes ignition and the creation of flame 100. The flame 100 expands in chamber 80 and radiates heat into the thermal zone of wall portions 84. Water 20 flowing through the upper and lower water sleeves 76 and 86 respectively then absorbs the heat radiated by thermal zone 84. The water 20 thus acts as a coolant to prevent over-heating of the inner wall 82 and casing 40 as well as the creation of the requisite steam and heated water which is emitted through orifices 88 within the lower bulk head 87. Steam and other gases produced by outgasing of the water 20 and preliminary steam generation within the water sleeve is permitted to bubble up and egress from vent tubes 99 to afford efficient and reliable operation of the generator 10. The gases and steam emitted from the water sleeve 86 are then mixed in the lower chamber 90 beneath the combustion zone 80 with the byproducts of combustion of the fuel and air. The vapor mixture is then permitted to egress through the lower bulk head 92 through exhaust port 94. The steam is utilized in filling the area of the casing 15 of the well bore 12 in the region of formation 14. The casing 15 is conventionally perforated in this region to permit the egress of the generated steam into the formation. Similarly, downhole apparatus of conventional design such as packer 199 are utilized to maintain the desired pressure and cause injection of the steam into the select regions of formation 14.

It is thus believed that the operation and construction of the above described vapor generator and the method of operation will be apparent from the foregoing description. While the vapor generator and method of operation thereof shown and described has been characterized as being preferred, it will be obvious that various changes and modifications may be made therein without departing from the spirit and scope of the invention as defined in the following claims.

What is claimed:

1. A method of generating steam within a well bore with a vapor generator disposed therein of the type having a combustion chamber for heating water and the gases present in the water to produce steam and hot gases for injection into a formation adjacent the well bore, said method comprising the steps of:

delivering a combustible fuel, oxidant, and water to the vapor generator within the well bore;

mixing the fuel and oxidant within the combustion chamber of the vapor generator;

igniting the fuel and oxidant mixture within the combustion chamber and sustaining combustion therein for generating radiant heat;

flowing water around the combustion chamber and establishing a water level therein;

absorbing radiant heat from the combustion within the combustion chamber by the water flowing therearound for converting the water into steam;

providing a vent tube longitudinally disposed within the water around said combustion chamber substantially along the length thereof and disposing one end of said vent tube above said established water level;

venting gases and steam emitted by the water while being heated around said combustion chamber through said vent tube;

discharging the steam formed from the heated water and the gases emitted by the water into a mixing region beneath the combustion occurring within the combustion chamber; and exhausting the steam and gas mixture from the vapor generator into the well bore formation.

2. The method as set forth in claim 1 wherein said method further comprises the step of providing a thermal radiator along the outer walls of the combustion chamber for receiving and radiating the heat of combustion into the water flowing therearound.

3. The method as set forth in claim 1 wherein said step of delivering fuel and oxidant to said combustion chamber includes the step of providing a pre-mixing chamber continuous said combustion chamber and in flow communication therewith, and mixing said fuel and oxidant in said pre-mixing chamber.

4. The method as set forth in claim 3 wherein said step of mixing said fuel and oxidant includes the step of tangentially injecting oxidant into said pre-mixing chamber for turbulent mixing with said fuel.

5. The method as set forth in claim 1 wherein the step of delivering the fuel, oxidant and water to the generator includes the step of providing a tubular pipe section above said combustion chamber, said pipe being concentrically constructed with three flow passages therein and simultaneously channeling the fuel, oxidant and water therethrough.

6. Apparatus for generating steam within a well bore of the type including a vapor generator having a combustion chamber for heating water and the gases present in the water to produce steam and hot gases for injection into a formation adjacent the well bore, said apparatus comprising:

means for delivering a combustible fuel, oxidant, and water to the vapor generator within the well bore;

means forming an upper mixing chamber disposed within the vapor generator and provided in communication with said fuel, oxidant delivery means for mixing the fuel and oxidant;

ignition means disposed within said mixing chamber for igniting the fuel and oxidant mixture to initiate combustion;

means forming a combustion chamber disposed beneath said mixing chamber for sustaining combustion within the vapor generator and generating radiant heat;

an annular sleeve around said combustion chamber forming an annular space therebetween, said annular space being in flow communication with said water delivery means for establishing a water level therein and absorbing radiant heat from the combustion within the combustion chamber by the water flowing therearound for converting the water into steam;

venting means disposed within said annular space and in flow communication with a lower portion of said combustion chamber for venting the steam formed from the heated water and the gases emitted by the water into a region beneath the combustion occurring within the combustion chamber;

said venting means including at least one vent tube longitudinally disposed within said annular space substantially along the length thereof with one end above said established water level; and means for exhausting the steam and gas mixture from the combustion chamber of the vapor generator into the well bore formation.

7. The apparatus as set forth in claim 6 wherein said delivering means includes a tubular pipe section above said combustion chamber, said pipe being concentrically, constructed with three flow passages therein for simultaneously channeling the fuel, oxidant and water therethrough and to the vapor generator.

8. The apparatus as set forth in claim 6 wherein said upper mixing chamber is formed of a cylindrical construction concentrically aligned contiguous the combustion chamber and having a lesser diameter than said combustion chamber for facilitating the expansion of the combustion gasses during flow and combustion therein.

9. The apparatus as set forth in claim 8 wherein said upper mixing chamber includes an outer cylindrical sleeve spaced therearound for the passage of oxidant into said mixing chamber.

10. The apparatus as set forth in claim 9 wherein said mixing chamber includes apertures formed tangentially through the cylindrical side walls thereof for the tangential injection of oxidant for mixing with fuel.

11. The apparatus as set forth in claim 6 wherein said vent tube is disposed within said annular sleeve with a first end secured at a lower portion of said combustion chamber for venting gases therein, and a second, upper end of said vent tube disposed above said upper mixing chamber for receiving steam and gases.

12. The apparatus as set forth in claim 6 wherein said combustion chamber includes cylindrical walls and a thermal lining therearound for receiving and outwardly radiating the heat generated by the combustion therein.

13. The apparatus as set forth in claim 12 wherein said thermal lining comprises high temperature mortar.

14. An improved down hole vapor generator of the type constructed for injecting steam and hot gases produced from water and gases present in the water into a well bore formation, wherein the vapor generator is of the type secured within a well bore and supplied with fuel and oxidant for the mixing and combustion thereof and transformation of water supplied thereto and maintained therein at an established level, into steam and hot gases, and the exhausting of said steam and gases under pressure into an adjacent well bore formation, wherein the improvement comprises means forming a combustion chamber and sleeve means cylindrically encompassing said combustion chamber and forming between said sleeve means and said combustion chamber an annular water chamber within the vapor generator, at least one venting tube longitudinally disposed in said annular chamber and extending substantially along the length of the annular chamber with one end thereof above the water level for receiving gases emitted by the water flowing into and within said annular chamber and a second end disposed outside the water chamber whereby the gases are vented.

15. The improved generator as set forth in claim 14 and including means for delivering fuel, oxidant and water to said generator, said means comprising a tubular pipe section above said combustion chamber, said pipe being concentrically constructed with three flow passages therein for simultaneously channeling said fuel, oxidant and water therethrough.

16. The improved generator as set forth in claim 14 wherein said combustion chamber includes an upper mixing chamber formed of cylindrical construction concentrically aligned with a lower body portion of said combustion chamber which is formed of a greater diameter than said mixing chamber for facilitating the expansion of the combustion gases.

17. The improved generator as set forth in claim 16 wherein said upper mixing chamber includes an outer cylindrical sleeve spaced therearound for the passage of oxidant into said mixing chamber.

18. The improved generator as set forth in claim 17 wherein said mixing chamber includes apertures formed tangentially through the cylindrical side walls thereof for the tangential injection of oxidant for mixing with the fuel.

19. The improved generator as set forth in claim 14 wherein said venting tube is disposed within said annular sleeve with a first end, secured at a lower portion of said combustion chamber for venting gases therein and a second, upper end of said vent tube disposed above said upper mixing chamber for receiving steam and gases.

20. The improved generator as set forth in claim 14 wherein said combustion chamber includes cylindrical walls and a thermal lining therearound for receiving and outwardly radiating the heat generated by the combustion therein.

21. The improved generator as set forth in claim 20 wherein said thermal lining comprises high temperature mortar.

22. Steam generation apparatus for operation within a well bore of the type including a vapor generator having a combustion chamber for heating water supplied thereto and the gases present in the water to produce steam and hot gases for injection into a formation adjacent the well bore, said apparatus comprising:

means for delivering a combustible fuel, oxidant, and water to the vapor generator within the well bore;

said delivering means including a tubular pipe section above said combustion chamber, said pipe being concentrically constructed with three flow passages therein for simultaneously channeling the fuel, oxidant and water therethrough;

an upper mixing chamber disposed within the vapor generator and provided in communication with said fuel, oxidant delivery means for mixing the fuel and oxidant;

said upper mixing chamber being formed of a cylindrical construction concentrically aligned contiguous the combustion chamber and having a lesser diameter than said combustion chamber for facilitating the expansion of the combustion gases during flow and combustion therein;

said upper mixing chamber including an outer cylindrical sleeve spaced therearound for the passage of oxidant into said mixing chamber;

said mixing chamber including apertures formed tangentially through the cylindrical side walls thereof for the tangential injection of oxidant for mixing with the fuel;

ignition means disposed within said mixing chamber for igniting the fuel and oxidant mixture to initiate combustion;

a combustion chamber disposed beneath said mixing chamber for sustaining combustion within the vapor generator and generating radiant heat;

said combustion chamber including cylindrical walls and a thermal lining therearound for receiving and outwardly radiating the heat generated by the combustion occurring therein;

an annular sleeve around said combustion chamber forming an annulus therebetween and provided in flow communication with said water delivery means for establishing a water level therein and absorbing radiant heat from the combustion within the combustion chamber by the water flowing therearound for converting the water into steam;

venting means disposed within said annular sleeve and in flow communication with a lower portion of said combustion chamber for venting the steam formed from the heated water and the gases emitted by the water into a region beneath the combustion occurring within the combustion chamber;

said venting means including at least one vent tube longitudinally disposed within said annular sleeve substantially along the length thereof with one end above said established water level;

means for exhausting the steam and gas mixture from the combustion chamber of the vapor generator into the well bore formation; and said vent tube being disposed within said annular sleeve with a first end secured at a lower portion of said combustion chamber for venting gases therein and a second, upper end of said vent tube disposed above said upper mixing chamber for receiving steam and gasses therein.

23. An improved method of generating steam within a well bore of the type utilizing a vapor generator having a generally cylindrical combustion chamber for heating water and the gases present in the water to produce steam and hot gases for injection into a formation adjacent the well bore and wherein a combustible fuel and oxidant is delivered to the vapor generator within the well bore for mixing within the combustion chamber being ignited therein for sustaining combustion which generates radiant heat to be absorbed by water flowing around the combustion chamber, wherein the improvement comprises the steps of:

providing an annular sleeve around the combustion chamber to comprise a water jacket therearound;

establishing a water level around the combustion chamber within the water jacket;

providing a pre-mixing chamber contiguous said combustion chamber and in flow communication therewith, and mixing said fuel and oxidant in said pre-mixing chamber;

tangentially injecting oxidant into said pre-mixing chamber for turbulent mixing with said fuel;

providing a thermal radiator along the outer walls of the combustion chamber for receiving and radiating the heat of combustion into the water flowing within the water jacket;

absorbing radiant heat from the combustion within the combustion chamber by the water within the water jacket for converting the water into steam;

providing at least one vent tube longitudinally disposed within the water jacket substantially along the length thereof with one end above the established water level for allowing the venting of water and gases and steam from the water;

venting the steam formed from the heated water and the gases emitted by the water from the vent tube into a mixing region beneath the combustion occurring within the combustion chamber; and exhausting the steam and gas mixture from the vapor generator into the well bore formation.

* * * * *